United States Patent [19]

Halbardier

[11] Patent Number: 4,869,325

[45] Date of Patent: Sep. 26, 1989

[54] METHOD AND APPARATUS FOR SETTING, UNSETTING, AND RETRIEVING A PACKER OR BRIDGE PLUG FROM A SUBTERRANEAN WELL

[75] Inventor: Anna L. Halbardier, Pasadena, Tex.

[73] Assignee: Baker Hughes Incorporated, Houston, Tex.

[21] Appl. No.: 225,737

[22] Filed: Jul. 29, 1988

Related U.S. Application Data

[60] Division of Ser. No. 113,172, Oct. 23, 1987, Pat. No. 4,805,699, which is a continuation-in-part of Ser. No. 877,421, Jun. 23, 1986, Pat. No. 4,708,208.

[51] Int. Cl.[4] ..... E21B 33/127

[52] U.S. Cl. ..... 166/387; 166/181; 166/187

[58] Field of Search ..... 166/123, 181, 182, 187, 166/373, 374, 387; 277/3, 34, 34.3, 34.6

[56] References Cited

U.S. PATENT DOCUMENTS

| | | | |
|---|---|---|---|
| 3,044,553 | 7/1962 | Bradley | 277/34 |
| 3,762,470 | 10/1973 | Eggleston | 166/182 |
| 3,912,014 | 10/1975 | Wetzel | 166/240 |
| 4,003,581 | 1/1977 | Hutchison | 166/187 |
| 4,082,298 | 4/1978 | Sanford | 277/34.3 |
| 4,163,562 | 8/1979 | Sanford | 277/34.3 |
| 4,566,535 | 1/1986 | Sanford | 166/152 |

*Primary Examiner*—Jerome W. Massie, IV
*Assistant Examiner*—Terry Lee Melius
*Attorney, Agent, or Firm*—Hubbard, Thurman, Turner & Tucker

[57] ABSTRACT

Methods and apparatus are provided for retrieving an inflatable packer or bridge plug of a type which may be passed through a small diameter tubing, seal against a relatively large diameter casing by passing fluid to the packer through a remedial tubing to inflate an elastomeric packing element and then be retrieved to the surface through the small diameter tubing by deflating the elastomeric packing element.

Circulation may be maintained during run-in through an open port in a centralizer member provided on the bottom of the packer or bridge plug. If the device is used as a bridge plug, the open port is closed by dropping a ball and applying pressure through the tubing to permanently close the open port preliminary to inflating the elastomeric elements.

3 Claims, 4 Drawing Sheets

METHOD AND APPARATUS FOR SETTING, UNSETTING, AND RETRIEVING A PACKER OR BRIDGE PLUG FROM A SUBTERRANEAN WELL

RELATIONSHIP TO COPENDING APPLICATION

This application constitutes a divisional of application 07/113,122, filed 10/23/87, now U.S. Pat. No. 4,805,699 which is a continuation in part of copending application No. 877,421, filed June 23, 1986, now U.S. Pat. No. 4,708,208, and assigned to the assignee of this application.

BACKGROUND OF THE INVENTION

1. Field of the Invention:

The present invention relates to methods and apparatus for setting and unsetting an inflatable packer or bridge plug in a subterranean oil or gas well be using coiled tubing or remedial tubing for pumping fluids to the packer. More particularly, the invention relates to improved methods and apparatus for running in and retrieving a packer or bridge plug sized to set in a casing through a relatively small diameter production tubing.

2. Description of the Prior Art:

Those skilled in the art relating to remedial operations associated with drilling, production, and completion of subterranean oil and gas wells have long utilized threaded or coupled remedial tubing inserted through production tubing for pumping fluids from the surface to one or more inflatable packers. More recently, continuous coiled remedial tubing has frequently replaced threaded or coupled tubing to pass fluid to a packer, since coiled tubing may be more rapidly inserted into the well, and may be easily passed through production tubing and related downhole equipment because its diameter is consistently the same size.

Typical remedial coiled tubing apparatus is described in the 1973 *Composite Catalog of Oil Field Equipment and Services,* at page 662 (Gulf Publishing Co., Houston, Texas), and manufactured by Bowen Tools, Inc. of Houston, Texas. Apparatus relating to this coiled tubing technique is more particularly described in U.S. Pat. Nos. 3,182,877 and 3,614,019.

The need frequently arises in remedial or stimulation operations to pass an inflatable packer or bridge plug through small diameter restrictions, e.g. 3½0 inch production tubing, set the packer in relatively large diameter casing, e.g., 7 inch casing, unset the packer or bridge plug and then retrieve the packer or bridge plug to the surface through the small diameter tubing. Recent advances, such as those disclosed in U.S. Pat. No. 4,349,204, enable inflatable packers or bridge plugs to pass through such small diameter tubing, effectively seal with a larger diameter casing, and then be retrievable to the surface through the small diameter tubing.

When it is desired to insert an inflatable bridge plug, a problem arises in maintaining circulation between the tubing bore and the annulus during run-in. Another significant problem in the art concerns retrieval of the packer or bridge plug elements, together with side pocket mandrels and similar tooling interconnected to the packer. During retrieval, if the packer or bridge plug or tooling get "hung up" on a restriction and conventional threaded remedial tubing is utilized to the pump fluid to the packer, the remedial tubing may be rotated to "free" the mismatch and enable the equipment to be removed through the production tubing.

This technique is not utilized with coiled tubing, however, since the coiled tubing cannot be effectively rotated. One technique for alleviating this problem is to attach a partial cone-shaped end to the lower end of the coiled tubing to permit the tubing to slide off the obstruction. Another technique alters the position of the end of the tubing with cams for producing a rotary motion in response to longitudinal motion on the tubing, as disclosed in U.S. Pat. No. 3,912,014.

Still another problem associated with the prior art concerns the interconnection of the coiled tubing with the downhole packer actuation assembly. Inflatable packers may be unset by pulling upwardly on the coiled tubing. Set screws have been utilized to connect the coiled tubing to the packer actuation assembly, and such set screws tend to loosen during downhole operations, allowing the tubing to pull away from the packer actuation assembly. Also, coiled tubing has broken off downhole above the packer actuation assembly/coiled tubing connection. In either event, retrieval of the packer actuation assembly, the packer, and interconnected downhole equipment is then a major problem, often requiring sophisticated fishing tool retrieval techniques.

SUMMARY OF THE INVENTION

Improved methods and apparatus are provided for setting and unsetting an inflatable packer or bridge plug of the type which is passed through a small diameter tubing while permitting circulation, then effectively seals against a relatively large diameter casing, and is then retrieved to the surface through the small diameter tubing. The term "packing tool" will hereinafter be utilized to designate a packer or bridge plug.

A centralizer is secured to the bottom end of the packing tool and has a circulation port maintaining communication between the tubing bore and the annulus surrounding the tubing. A ball seat is defined by an axially shiftable valve sleeve in the bore of the centralizer which is shear pinned in a position permitting fluid flow through said circulation port. A ball or plug is dropped onto the ball seat and the tubing pressure is increased to a level to shear the valve sleeve shear pin and the valve sleeve moves downwardly to permanently close the circulation port. The packing tool is set by a further increase in fluid pressure in the remedial tubing. When pressure increases, a poppet valve in the packing tool opens, exposing a piston member to fluid pressure. When the tubing fluid pressure reaches a predetermined level, the piston securing pin shears, permitting fluid to pass to the expandable packing elements and inflate the packing tool. When the tubing fluid pressure reaches a predetermined maximum preferred value and the packing tool is set, a plug pin shears, dumping fluid to the well and closing the poppet valve to retain the expanded packing elements in sealed engagement with the casing.

If used as a bridge plug, the remedial tubing is normally disconnected by a further increase in tubing pressure as described below. If used as a packer, the disconnection is not necessary and, after the remedial or stimulation operation is complete, pressure above and below the expanded packing elements is equalized by opening a port between the interior of the apparatus and the annulus above the packing tool.

The packing tool is unset by pulling upward on the remedial tubing, or exposed fishing neck if disconnection has been effected, until a third pin shears, allowing a by-pass passage in an internal sleeve to move axially relative to the housing, dumping fluid from the packing tool.

During retrieval by the remedial tubing, the tool may become hung up to the extent that the maximum recommended axial force on the remedial tubing cannot free the obstruction. Rather than break the remedial tubing or the tubing/packer actuator assembly connection, another ball may be dropped through the remedial tubing to seal with a seat on the upper portion of the packing tool actuation assembly, and fluid again pumped through the remedial tubing to shear a fourth pin, enabling the upper subassembly to be released from the remainder of the packing tool actuation assembly. The upper subassembly and remedial tubing may then be retrieved together to the surface, and a conventional fishing tool lowered on a wireline for grasping an exposed fishing neck portion of the lower subassembly of the actuator assembly. The fishing tool and wireline may then be used to retrieve the remaining portion of the packer actuator assembly, the packer, and interconnected equipment.

DETAILED DESCRIPTION OF PREFERRED EMBODIMENTS

Figure 1:
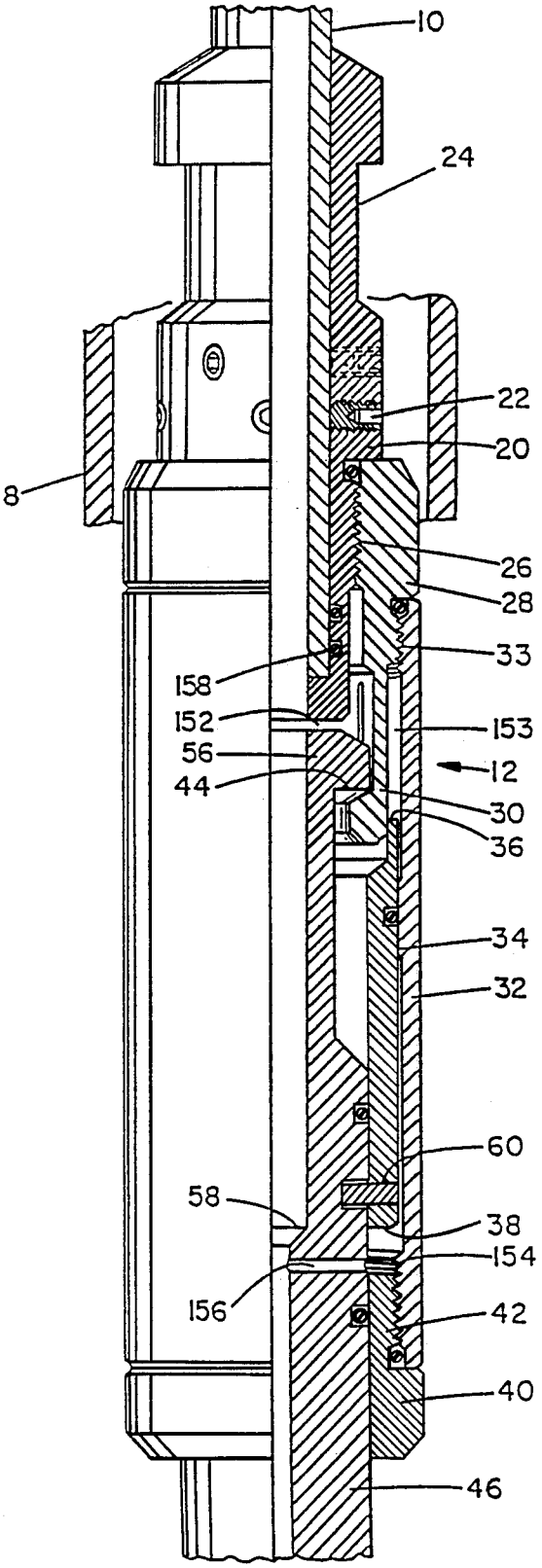
FIGS. 1, 1A, 1B and 1C are vertical sectional views, partially in cross-section, showing the packing tool actuation assembly, a packing tool, and a plug according to the present invention.
Figure 1A:
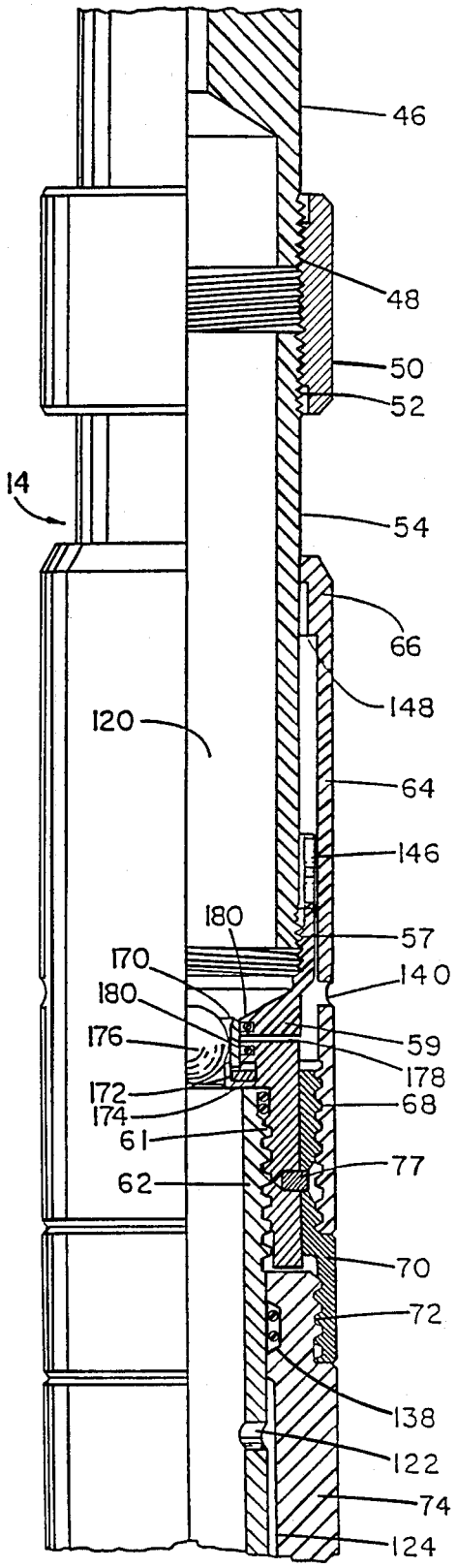
Figure 1B:
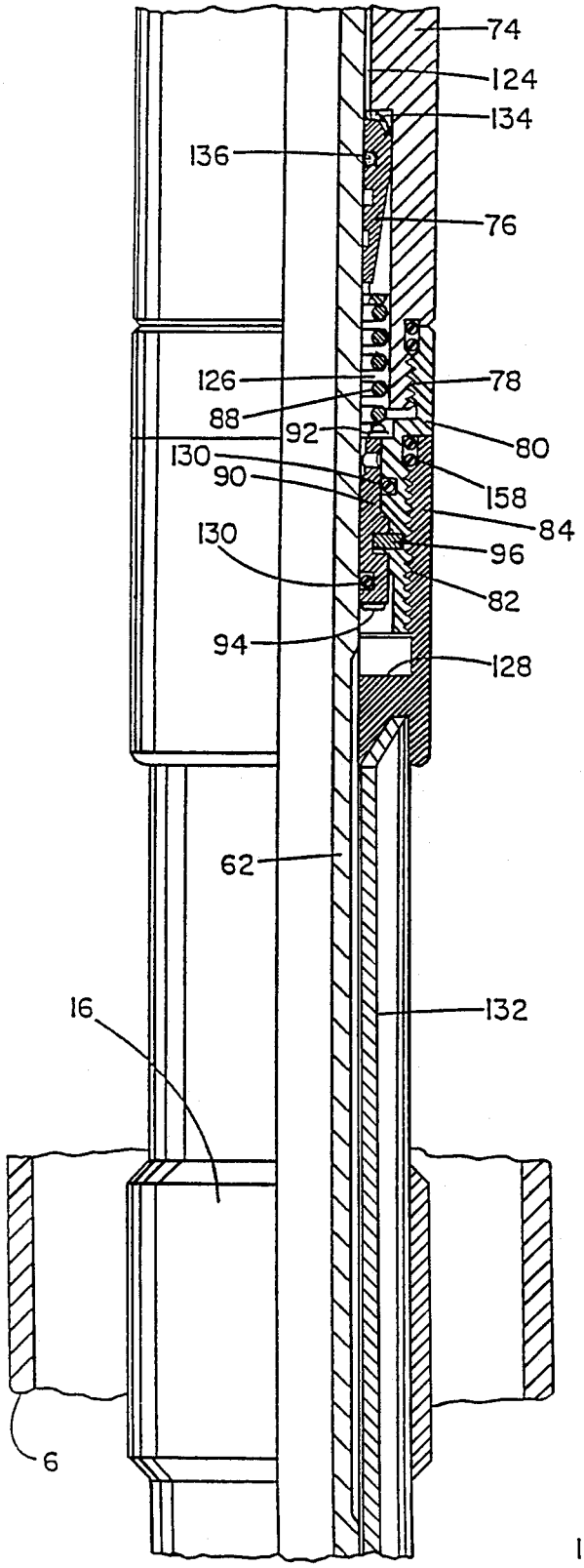
Figure 1C:
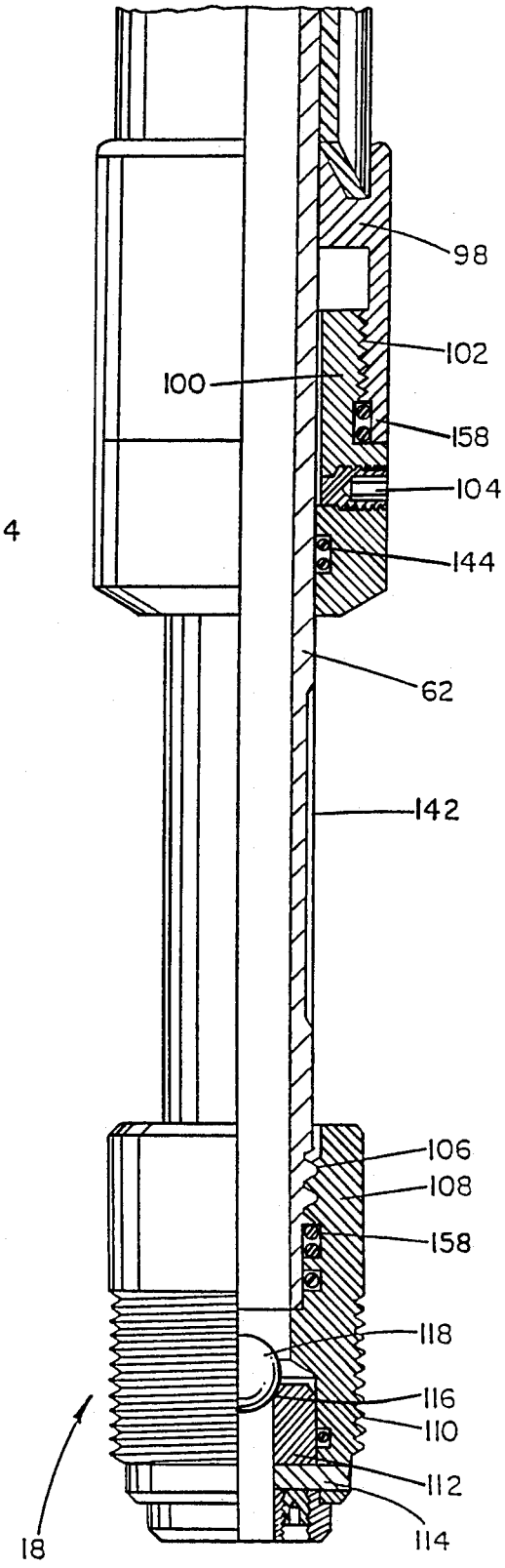

FIGS. 1, 1A, 1B, and 1C depict a packing tool actuator assembly according to one embodiment of the present invention connected to an end of coiled remedial tubing 10. Either coiled tubing 10 or conventional threaded remedial tubing may be utilized to lower the packing tool to its desired position in a well by passing through production tubing 8 beyond its lower end to extend into the open bore of casing 6. The packing tool is actuated to seal against the interior bore surface of casing 6, is subsequently deactivated or "unset", and then may be retrieved to the surface through the production tubing 8. Setting and unsetting of the packing tool is controlled by passing fluid under pressure from the surface to the packing tool actuator assembly through the coiled tubing 10.

The packing tool actuator assembly includes a removable upper subassembly 12 and a main body subassembly 14 described subsequently. The actuator assembly controls passage of fluid to and from expandable packer element 16 to set and unset the packer against the interior wall of casing 6. The lower plug assembly 18 is attached beneath packer element 16, and is utilized during the setting and unsetting operation.

Upper sub assembly 12 includes a top sub 20 interconnected to tubing 10 by a plurality of threaded set screws 22. Top sub 20 includes a fishing neck portion 24 for receiving a conventional fishing tool under circumstances described subsequently. The top sub is threaded at 26 for engagement with an upper pilot sub 28 carrying a plurality of collet fingers 30. Outer sleeve 32 is threaded at 33 for engagement with the upper pilot sub 28, and houses annular piston 34 having an upper surface 36 and a lower surface 38. Dynamic seals 35 effect the sealing of the inner and outer walls of annular piston 34. A lower pilot sub 40 is threaded at 42 for engagement with sleeve 32. When lowering the assembly shown in FIG. 1, 1A, 1B and 1C in the well, subassembly 12 is interconnected to main body subassembly 14 since collet fingers 30 are prevented from moving radially outwardly because of piston 34. The ends of collet fingers 30 thus engage surface 44 of upper sub 46 to prevent axial movement of subassembly 12 relative to subassembly 14.

Upper sub 46 is threaded at 48 to collar 50, which in turn is threaded at 52 to elongated sleeve 55 of subassembly 14. Upper sub 46 includes a fishing neck portion 56 and a ball seat 58 whose functions are described subsequently. Slidable piston 34 is normally fixed relative to upper sub 46 by shear pin 60.

The lower end of sleeve 54 is threaded at 57 for engagement with intermediate sub 59, which in turn is threaded at 61 for engagement with sleeve 62. Ball seat 170 covers ports 178 in intermediate sub 59. Retainer 174 is sandwiched between sub 59 and sleeve 62, and shear pins 172 interconnect the retainer and the ball seat. Seals 180 provide sealed engagement between ball seat 170 and sub 59. As explained hereafter, ball 176 seats on surface 180, and fluid pressure above the ball shears pins 172, thereby allowing fluid to pass through port 178 in sub 59 and out port 140. The majority of sleeve 54 is protected within housing 64 having an—end portion 66 in sliding engagement with the outer surface of sleeve 54.

Housing 64 is threaded at 68 for engagement with pin sub 70, which in turn is threaded at 72 for engagement with lower sub 74. Upper movement of intermediate sub 59 relative to housing 64 is normally prevented by shear pin 77, which interconnects the intermediate sub 59 and the pin sub 70. Lower sub 74 is threaded at 78 to piston sub 80, which in turn is threaded at 82 to upper packer sub 84. Poppet valve 76 is housed between the lower sub 74 and the sleeve 62, and is normally held in the sealed position by a coil spring 88. Slidable piston 90 has an upper piston surface 92 and a lower piston surface 94, and is normally axially secured relative to piston sub 80 by shear pin 96.

Packer element 16 is thus positioned between upper packer sub 84 and lower packer sub 98 in a conventional manner. Sub 100 is threaded at 102 with lower packer sub 98, and includes a removable plug 104. The lower end of sleeve 62 is threaded at 106 with plug sub 108, which contains conventional exterior pipe threads 110 for engagement with additional conventional oilfield equipment. Plug 112 is normally secured to plug sub 108 by a plurality of shear pins 114, and contains seat 116 for sealing engagement with a ball 118 dropped through tubing 10.

It should thus be understood that the entire assembly shown in FIG. 1 may be lowered in a subterranean well through production tubing 8 by a coiled tubing 10. With the packer element 16 positioned at a selected position within the casing 6, the packer setting operation may be commenced.

Figure 2:
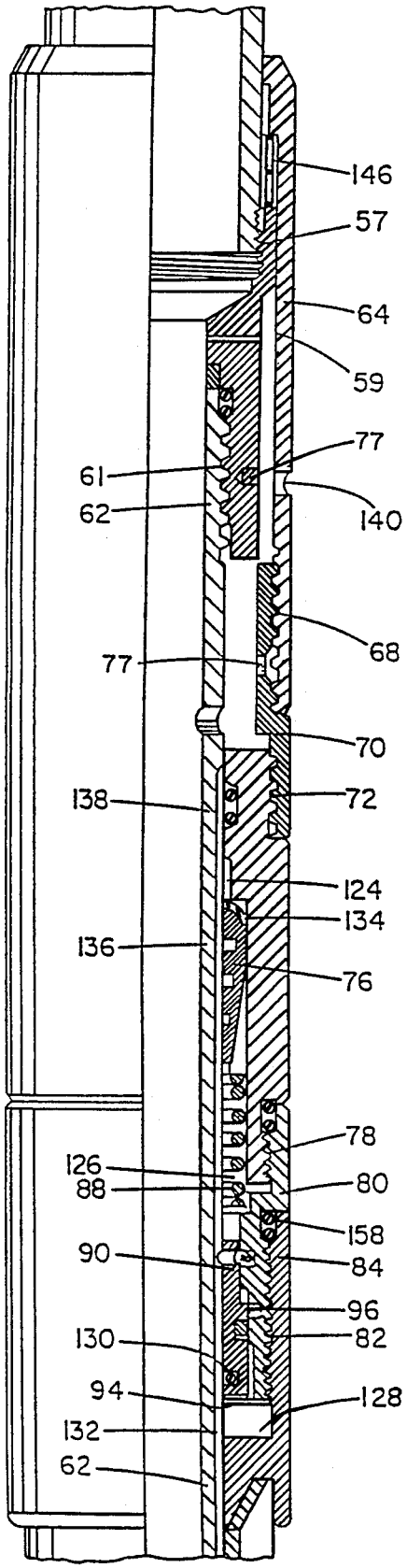
FIG. 2 is a vertical view, partially in cross-section, of a portion of the apparatus shown in FIG. 1 with the sleeve moved axially with respect to the housing to deflate the packer.

To set the packing tool, ball 118 may be dropped from the surface through coiled tubing 10 and central passageway 120 of the packer setting assembly to engage the plug 112 and seal against seat 116. Pressurized fluid may then be pumped from the surface through the coiled tubing 10 to central passageway 120 and through inflation port 122 in sleeve 62. Pressurized fluid in passageway 124 between sleeve 62 and lower sub 74 thus acts against poppet valve 76, causing poppet valve 76 to compress spring 88 until fluid passes by the poppet valve and into passageway 126. A further increase in fluid pressure acting on upper surface 92 of piston 90 causes pin 96 to shear at a preselected pressure, e.g., 900 p.s.i.g. Piston 90 thus moves downward until surface 94 engages stop surface 128 on upper packer sub 84 (see FIG. 2). It may be seen that downward movement of piston 90 allows fluid to bypass piston seals 130, allowing fluid to pass from passageway 126 to passageways provided by a plurality of elongate upper grooves 132 in sleeve 62, and enabling fluid to pass to the inflatable members in the packer element 16 and inflate the expandable packing element 16.

Once the packing element 16 has been inflated to effectively seal against the side of the casing 6, the pressure in central passageway 120 will increase until the maxium recommended pressure of the packer is obtained, e.g., 1700 p.s.i.g. At this point, pins 114 will shear, allowing plug 112 and ball 118 to be discharged from plug sub 108, thereby rapidly lowering the pressure in the central passageway 120.

This opening of the central bore of the entire tool is especially desirable for packer applications, but cannot, without additional structure, effectively function as a bridge plug.

The resulting pressure decrease, in combination with spring 88, will cause poppet valve 76 to return to its sealed position, with edge seal 134 returning to sealed engagement with lower sub 74, and seal 136 providing sealing engagement between poppet valve 76 and sleeve 62. Thus once plug 112 is blown out of the bottom of plug sub 108, fluid at the desired pressure of, e.g., 1700 p.s.i.g., is retained within the expandable packer element 16 to enable the packer element 16 to effectively seal against the casing 6.

When it is desired to unset the packing tool after completion of the remedial or stimulation operation, intermediate ball 176 may be dropped from the surface through the tubing string, and seat against surface 180. Thereafter, fluid pressure is applied through the coiled tubing against the ball until the selected fluid pressure, e.g., 1700 p.s.i.g., is sufficient to shear pins 172. Once sheared, the ball and seat are pushed downward through the bore of the tool, and fluid communication is established between the interior 120 of the subassembly 14 and the annulus between the subassembly 14 and the casing 6.

The above-described operation equalizes the pressure in the casing 6 above the expandable packer element 16 to approximately the pressure below the packer element 16, since fluid in the casing below the packer is free to travel up the central passageway of the tool and through ports 178 and 140 once pins 172 shear. If pressure is not substantially equalized above and below the packer element 16 before the packer element is depressurized, the higher pressure in the casing 6 below the packer element 16 may create a sufficient upward force on the packer element to buckle or break the coiled tubing 10. In such a case, not only is the tubing 10 damaged, but the packer element 16 thereafter may not be deflated in its intended manner.

Once pressure equalization has occurred, an upward force may be applied to coiled tubing 10, thereby exerting an upward force on intermediate sub 59 relative to pin sub 70. Once a selected upward force, e.g., 3400 pounds, has been applied to tubing 10, pins 77 will shear, enabling sleeve 54 to move upwardly relative to housing 64 (see FIG. 2). As sleeve 62 moves upward with sleeve 54 relative to lower sub 74, upper grooves 132 pass by poppet valve 76 and seals 138, allowing fluid to discharge from the packer element through port 140 in housing 64. Simultaneously, a plurality of elongate lower grooves 142 in sleeve 62 provide a flow discharge path from packer element 16 past seals 144. Fluid may thus be simultaneously discharged from the packer element at locations both above and below the packer element 16, causing the packer element 16 to deflate. Upward jarring movement of sleeve 62 relative to lower sub 74 is cushioned when shock absorbing sleeve 146 is compressed between the end of intermediate sub 59 and the stop surface 148 on housing 64.

During the packing tool retrieval operation, it is possible for the packer element 16 or equipment connected therewith to become "hung up" or "caught", so that the removal operation cannot proceed. This "hang up" condition may be due to the upper pilot sub 28 catching on a production tubing joint, or may be due to a lower component in the assembly, such as the packing element 16, catching on a lower component on the well. In either event, it is undesirable to exert an upward force on the coiled tubing 10 beyond the recommended tensile force for the coiled tubing, since the tubing may break at a location above the top sub 20, creating a major problem for the subsequent removal of the packer actuator assembly and the packer. According to the present invention, methods and apparatus are provided for enabling subassembly 12 to be disconnected from subassembly 14 when such a hang up condition occurs.

Figure 3:
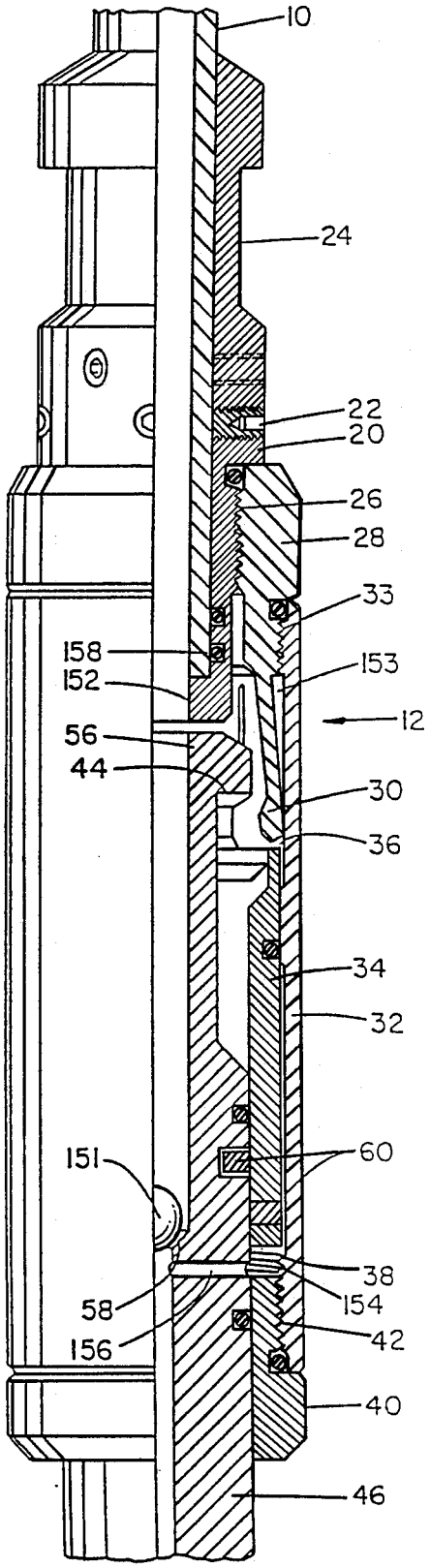
FIG. 3 is a vertical view, partially in cross-section, showing the upper subassembly of the packer actuator assembly in position to be disconnected from the remainder of the actuator assembly.

If the assembly shown in FIG. 1 cannot be freed with the maximum recommended axial force on tubing 10, another ball 151 (see FIG. 3) may be dropped from the surface through the coiled tubing 10 and seat on ball seat 58 of upper sub 46. Thereafter, fluid may be injected through the coiled tubing, causing fluid to pass through gap 152 between upper sub 46 and top sub 20. Fluid passes by the collet fingers 30, and a pressure increase in passageway 152 acts on top surface 36 of piston 34 until a selected fluid pressure, e.g., 1075 p.s.i., is obtained, causing pin 60 to shear and forcing piston 34 downwardly against stop surface 154 (see FIG. 3). Since fluid pressure beneath seat 58 is lower than the pressure above ball 151, the downward movement of piston 34 expels fluid beneath the piston through passageway 156. Once the piston 34 has moved downward, collet fingers 30 are free to move radially outwardly relative to upper sub 46 (see FIG. 3), so that upper pilot sub 28 may become disconnected from upper sub 46. Once the piston has moved downward, the coiled tubing 10 with subassembly 12 may be pulled to the surface, exposing fishing neck portion 56 of upper sub 46 for engagement with a conventional fishing tool. Using a conventional fishing tool and a wireline (not shown), the fishing tool may grasp the special fishing neck portion 56 of upper sub 46, and a substantial upward and/or rotational force exerted on upper sub 56 through the wireline to free the hang up and enable the remaining apparatus, including the packing tool, to pass through the production tubing 8.

Of course, in some cases, it may be desired to disconnect the coiled tubing from the set packing tool. The same procedure is followed and the exposed fishing neck portion 56 may be engaged by a wireline fishing tool and thereby exert an upward force on intermediate sub 59 to effect the unsetting of the packing tool in the same manner as described above.

The present invention thus enables the subassembly 12 to be easily detached from the subassembly 14 connected to the packer elements, so that subassembly 12 may be removed with the coiled tubing rather than subject tubing 10 to a higher than recommended axial force. If, for some reason, tubing 10 should ever become inadvertently disconnected from subassembly 12, the remainder of the tubing 10 may be removed from the wellbore, and a conventional fishing tool lowered by wireline (not shown) for engagement with fishing neck portion 24.

Those skilled in the art will recognize that a plurality of static seals, such as O-rings 158, are provided at the locations indicted in the figures, and maintain sealing engagement between the respective components illustrated. The relatively large diameter passageway 120 enables tooling to be passed down through the assembly shown in FIGS. 1, 1A, 1B and 1C subsequent to the expulsion of plug 112, in order that additional operations may be performed beneath the set packer.

Figure 4:
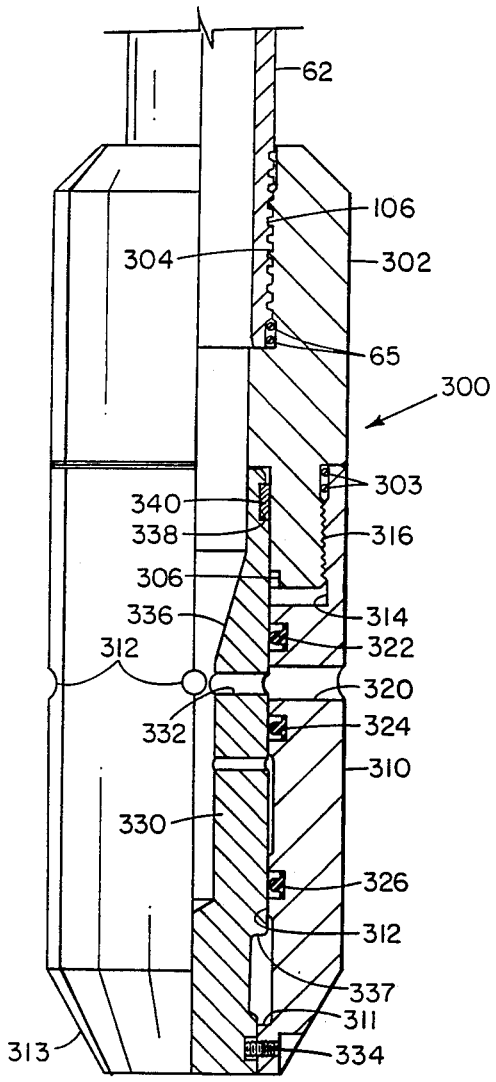
FIG. 4 is a vertical quarter sectional view of a modified plug comprising a centralizer incorporating a circulation valve, shown in an open position.

If the packing tool is to be employed as a bridge plug, then the modification illustrated in FIG. 4 may be utilized to provide a closed bottom end for the bore of the coiled tubing 10 and yet permit circulation while the packing tool is being inserted into the well. A centralizer 300 is substituted for the plug 18 employed in the previously described modification. Centralizer 300 comprises an upper mounting sub 302 having internal threads 304 for engagement with the external threads 106 provided on the bottom end of sleeve 62. O-rings 65 seal this threaded connection. The lower valving portion 310 of centralizer 300 has an internal bore 312 communicating with an enlarged counter bore 314 at its upper end. Counter bore 314 is provided with internal threads 316 which threadably cooperate with similar threads formed on the bottom end of upper sub 302. O-rings 303 seal this threaded connection.

The lower portion 310 of the centralizer 300 is further provided with a plurality of radial ports 320 communicating between the bore 312 and the casing annulus. Such ports are maintained in an open or closed position by a solid bottom sleeve valve 330 which is slidably mounted in the bore 312 and has a plurality of radial ports 332 respectively communicating with ports 320. Sleeve valve 330 is held in its open or port communicating position by one or more shear pins 334. O-rings 332 and 324 in bore 312 seal the radial ports 320 and 332.

Figure 5:
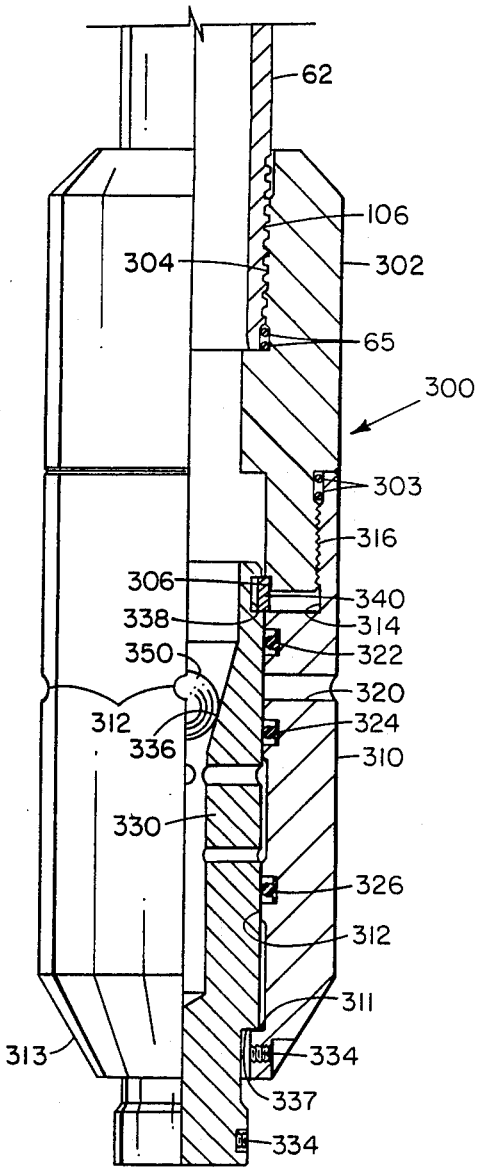
FIG. 5 is a view similar to FIG. 4 but showing the circulation valve in its closed position.

Above the ports 332, the sleeve valve 330 is provided with a conical valve seating surface 336 upon which an actuating ball 350 (FIG. 5) may be dropped to permit pressure to be developed within the bore of tubing 10 and sleeve 62 sufficient to effect the shearing of shear pin 334 and the downward displacement of the sleeve valve 330 to the position illustrated in FIG. 5 wherein the sleeve valve ports 332 are positioned between two O-ring seals 324 and 326 provided in the bore surface 312 and thus sealed off.

To lock the sleeve valve 330 in its non-circulating, or closed position, an expandable lock ring 340 is provided in an annular groove 338 formed in the outer upper extremity of the sleeve valve 330. Locking ring 340 snaps into engagement with an annular recess 306 formed in the bottom end of the upper sub 302 and permanently secures the sleeve 330 in its downwardly displaced position. A downwardly facing shoulder 337 on sleeve valve 330 engages an upwardly projecting shoulder 311 formed on the bottom end of the lower portion 310 of the centralizer 300. Additionally, the lower extremity of the lower portion 310 of centralizer 300 is provided with an inwardly tapered surface 313 to facilitate the guiding of the tool around obstructions encountered in the tubing string 8 as the packing tool is inserted in the well.

It is therefore apparent that during the well insertion process, circulation may be maintained through the aligned ports 332 and 320 n the centralizer 300. Upon dropping a ball into engagement with the conical surface 336, and increasing the pressure in the coiled tubing 10, the pin 334 is sheared and valve 330 shifts to the downward position, shown in FIG. 5, permanently closing off any fluid path communicating with the casing annulus and hence the packing tool, when set, will function as a bridge plug.

As used herein, the term "remedial" tubing refers to conduit used to pass fluids to a packer to set the packer in a subterranean well, and includes both coiled tubing previously described and threaded or coupled tubing sections.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of inflating an inflatable packing tool in a subterranean well having a large diameter bore and a relatively small diameter tubing string traversing the well bore and terminating at a position above the desired inflation location of the inflatable tool, said inflatable packing tool having a tubular body and an annular inflatable element surrounding said tubular body, comprising the steps of:

connecting a hollow housing having a closed bottom end on the bottom of said tubular body, said hollow housing having a radial port and a valve sleeve positioned by a shearable member within the hollow portion of said hollow housing above said radial port;

suspending the top end of said body portion on a remedial tubing string;

lowering said inflatable tool and hollow housing through said relatively small diameter tubing string on said remedial tubing string to said selected position while maintaining fluid circulation through said hollow housing port;

positioning a valve member on said valve sleeve to block fluid passage through the bore of said tubular body;

supplying pressurized fluid through said remedial tubing string to force said valve sleeve downward to shear the shearable member and to close said radial port; and further increasing the pressure of said pressurized fluid to expand said annular inflatable element into sealing engagement with said large diameter well bore.

2. The method of claim 1 further comprising the step of locking said valve sleeve in said port closing position.

3. The method of inflating an inflatable packing tool in a subterranean well having a large diameter bore and a relatively small diameter tubing string traversing the well bore and terminating at a position above the desired inflation location of the inflatable tool, said inflatable packing tool having a tubular body and an annular inflatable element surrounding said tubular body, comprising the steps of:

connecting a hollow housing having a closed bottom end on the bottom of said tubular body, said hollow housing having a radial port and a valve sleeve positioned by a shearable member within the hollow portion of said hollow housing above said radial port;

suspending the top end of said body portion on a remedial tubing string;

lowering said inflatable tool and hollow housing through said relatively small diameter tubing string on said remedial tubing string to said selected position while maintaining fluid circulation through said hollow housing port;

positioning a valve member on said valve sleeve to block fluid passage through the bore of said tubular body;

supplying pressurized fluid through said remedial tubing string to force said valve sleeve downward to shear the shearable member and to close said radial port;

further increasing the pressure of said pressurized fluid to expand said annular inflatable element into sealing engagement with said large diameter well bore; and releasing pressurized fluid from the bore of said tubular body while retaining pressurized fluid within the inflatable element sufficient to maintain the packing tool set.

* * * * *